US009938793B2

(12) United States Patent
Hashemian et al.

(10) Patent No.: US 9,938,793 B2
(45) Date of Patent: Apr. 10, 2018

(54) SPHERICAL BLOW OUT PREVENTER ANNULAR SEAL

(71) Applicant: Freudenberg Oil & Gas, LLC, Houston, TX (US)

(72) Inventors: Mehdi Hashemian, Kingwood, TX (US); Andreas Hagen, Rimbach (DE); Christopher Neumann, Lautertal (DE); Bernd Altmueller, Birkenau (DE)

(73) Assignee: Freudenberg Oil & Gas, LLC, Houston, TX (US)

( * ) Notice: Subject to any disclaimer, the term of this patent is extended or adjusted under 35 U.S.C. 154(b) by 10 days.

(21) Appl. No.: 14/950,330

(22) Filed: Nov. 24, 2015

(65) Prior Publication Data

US 2017/0145770 A1 May 25, 2017

(51) Int. Cl.
*E21B 33/06* (2006.01)
*E21B 33/08* (2006.01)

(52) U.S. Cl.
CPC ..... *E21B 33/06* (2013.01); *E21B 33/085* (2013.01)

(58) Field of Classification Search
CPC ..... E21B 33/06; E21B 33/061; E21B 33/062; E21B 33/063; E21B 33/085
USPC ..... 251/1.1, 1.2, 1.3, 212; 166/85.1, 85.4; 277/327, 324
See application file for complete search history.

(56) References Cited

U.S. PATENT DOCUMENTS 2,243,340 A 5/1941 Hild
2,760,795 A 8/1956 Vertson
3,572,627 A * 3/1971 Jones ..... E21B 33/06 251/1.2
3,587,734 A 6/1971 Shaffer
3,667,721 A * 6/1972 Vujasinovic ..... E21B 33/06 251/1.1
3,737,139 A 6/1973 Watts
3,897,040 A 7/1975 Le Rouax
3,897,071 A 7/1975 Le Rouax
3,994,472 A 11/1976 Williams
(Continued)

FOREIGN PATENT DOCUMENTS

EP 113413 A2 7/1984
EP 122708 A2 10/1984
(Continued)

*Primary Examiner* — Craig J Price
*Assistant Examiner* — Andrew J Rost
(74) *Attorney, Agent, or Firm* — Daniel J. Sepanik, Esq.; Harness, Dickey & Pierce, PLC

(57) ABSTRACT

A spherical blow out preventer annular seal is provided for sealing around a pipe. The blow out preventer includes a housing adapted to be disposed around the pipe and having a generally spherical interior surface. A seal body includes a plurality of metallic inserts arranged side by side in an annular pattern and each includes a base portion and a wedge shaped extension having a partially spherical outer surface terminating at a tip end. An annular elastomeric body is over-molded on the base portions of the plurality of metallic inserts with the partially spherical outer surface of each of the wedge shaped extensions being supported in engagement with the interior spherical surface of the housing. A piston is engaged with the seal body to press the metallic inserts upward and inward against the generally spherical interior surface of the housing so as to come together tangentially around the pipe.

18 Claims, 5 Drawing Sheets

(56) References Cited

U.S. PATENT DOCUMENTS

| | | | | |
|---|---|---|---|---|
| 4,007,904 | A | 2/1977 | Jones | |
| 4,030,354 | A | 6/1977 | Scott | |
| 4,095,805 | A | 6/1978 | Allen | |
| 4,098,516 | A | 7/1978 | Murman | |
| 4,099,699 | A | 7/1978 | Allen | |
| 4,310,139 | A | 1/1982 | Williams, III et al. | |
| 4,438,900 | A | 3/1984 | Schaeper et al. | |
| 4,448,255 | A | 5/1984 | Shaffer et al. | |
| 4,458,876 | A | 7/1984 | Schaeper et al. | |
| 4,460,149 | A * | 7/1984 | Schaeper ..... | E21B 33/06 251/1.2 |
| 4,460,150 | A | 7/1984 | Turlak et al. | |
| 4,460,151 | A | 7/1984 | Williams, III et al. | |
| 4,602,794 | A | 7/1986 | Schaeper et al. | |
| 4,605,195 | A | 8/1986 | Burton et al. | |
| 4,949,785 | A | 8/1990 | Beard et al. | |
| 5,116,017 | A | 5/1992 | Granger et al. | |
| 5,251,869 | A | 10/1993 | Mason | |
| 5,277,249 | A | 1/1994 | Yenulis et al. | |
| 8,176,933 | B2 | 5/2012 | Huff et al. | |
| 2008/0066906 | A1 | 3/2008 | Huff et al. | |

FOREIGN PATENT DOCUMENTS

| | | | |
|---|---|---|---|
| GB | 1512658 | A | 6/1978 |
| GB | 1539471 | A | 1/1979 |
| GB | 1539472 | A | 1/1979 |
| MX | 2009001111 | A | 10/2009 |
| RU | 1798480 | C | 2/1993 |
| RU | 2324806 | C2 | 5/2008 |
| SU | 819302 | | 4/1981 |
| SU | 1189995 | | 11/1985 |
| SU | 1263807 | | 10/1986 |
| WO | 9827313 | A1 | 6/1998 |
| WO | 2008039589 | A1 | 4/2008 |
| WO | 2012159466 | A1 | 11/2012 |
| WO | 2014004420 | A2 | 1/2014 |

* cited by examiner

SPHERICAL BLOW OUT PREVENTER ANNULAR SEAL

FIELD

The present disclosure relates to a spherical blow out preventer annular seal for use on a drilling rig.

BACKGROUND

This section provides background information related to the present disclosure which is not necessarily prior art.

In oil well drilling operations, subsurface high pressure gas pockets can be encountered. A blow out preventer is required to prevent the release of the high pressure upwards through the drilling hole. Blow preventers are mounted in a housing surrounding a drill hole. Typical blow preventers have a resilient sealing means which can be caused to tightly grip the outer circumferential surfaces of various diameter drill string components to prevent pressure from subterranean gas pockets from blowing out material along the drilling string. Most oil well blow out preventers are remotely activated, as by a hydraulically actuated piston. Drilling activities are reaching into deeper and harder reservoirs and existing blow out preventer products are being challenged to function at higher temperatures and pressures. The conventional anti-extrusion barrier is designed to close on the largest diameter drill pipe and its operating range does not eliminate the gap in the anti-extrusion barrier which remains when closing on small pipe sizes. This gap is filled with compressed elastomer and is prone to be extruded at elevated temperature and pressure, causing a leak path for the contained fluids.

SUMMARY

This section provides a general summary of the disclosure, and is not a comprehensive disclosure of its full scope or all of its features.

A spherical blow out preventer annular seal is provided for sealing around a pipe. The blow out preventer includes a housing adapted to be disposed around the pipe and having a generally spherical interior surface. A seal body includes a plurality of metallic inserts arranged side by side in an annular pattern and each includes a base portion and a wedge shaped extension having a partially spherical outer surface terminating at a tip end. An annular elastomeric body is over-molded on the base portions of the plurality of metallic inserts with the partially spherical outer surface of each of the wedge shaped extensions being supported in engagement with the interior spherical surface of the housing. A piston is engaged with the seal body to press the metallic inserts upward and inward against the generally spherical interior surface of the housing so as to come together tangentially around the pipe.

The upward movement of the hydraulic piston in a spherical blow out preventer drives the metals segments upward and inward to form an anti-extrusion barrier and at the same time forces the rubber into a smaller space thus moving it inward to build contact pressure against the pipe, thus effecting a seal. The tangential movement of the inserts of the present disclosure allow further upward movement of the piston after the metal segments have made contact with the pipe or with each other. This is achieved by the tangential movement of segments relative to each other. This allows use of longer segments resulting in smaller extrusion gaps while providing improved contact stress and thus improved sealing functions across different pipe diameters in a certain range.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
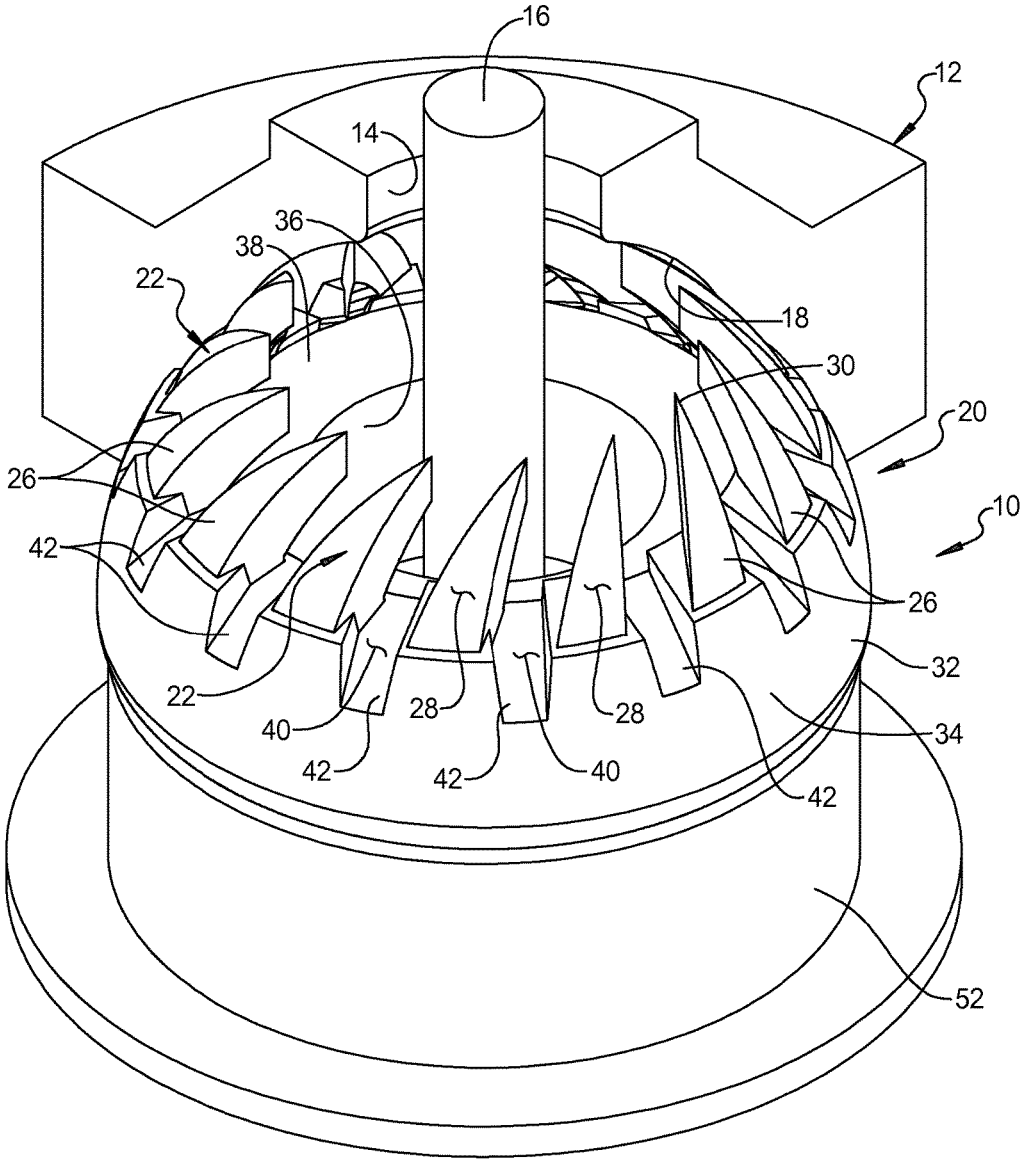
FIG. 1 is a partially cut-away perspective view of a spherical blow out preventer annular seal surrounding a pipe in an un-deformed state according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a spherical blow out preventer 10 according to the principles of the present disclosure will now be described. The spherical blow out preventer 10 includes an annular housing 12 (shown in partial cutaway view for illustrative purposes) having an opening 14 receiving a pipe 16 and having a generally spherical interior surface 18. The annular housing 12 can be made of steel, other metals or other materials that can withstand high temperatures and pressures.

A seal body 20 is disposed within the annular housing 12. The seal body 20 includes a plurality of metallic inserts 22 arranged in a side-by-side annular pattern. As best shown in FIGS. 2-5, the metallic inserts 22 include a base portion 24 and a wedge-shaped extension 26 having a partially spherical outer surface 28 terminating at a tip end 30. With continued reference to FIG. 1, an annular elastomeric body 32 is over-molded on the base portions 24 of the plurality of metallic inserts 22. The elastomeric body 32 supports each of the metallic inserts 22 with the partially spherical outer surface 28 of each of the wedge-shaped extensions 26 being supported in engagement with the interior spherical surface 18 of the annular housing 12. The elastomeric body 32 includes a partially spherical outer surface 34, a generally cylindrical inner surface 36 and a generally conical inner surface 38 extending from the generally cylindrical inner surface 36. The elastomeric body 32 may define a recessed gap region 40 in the elastomeric body between each metallic insert 22. The gap region 40 can include a generally conical-shaped outer surface 42 although other shapes may be used.

Figure 4:
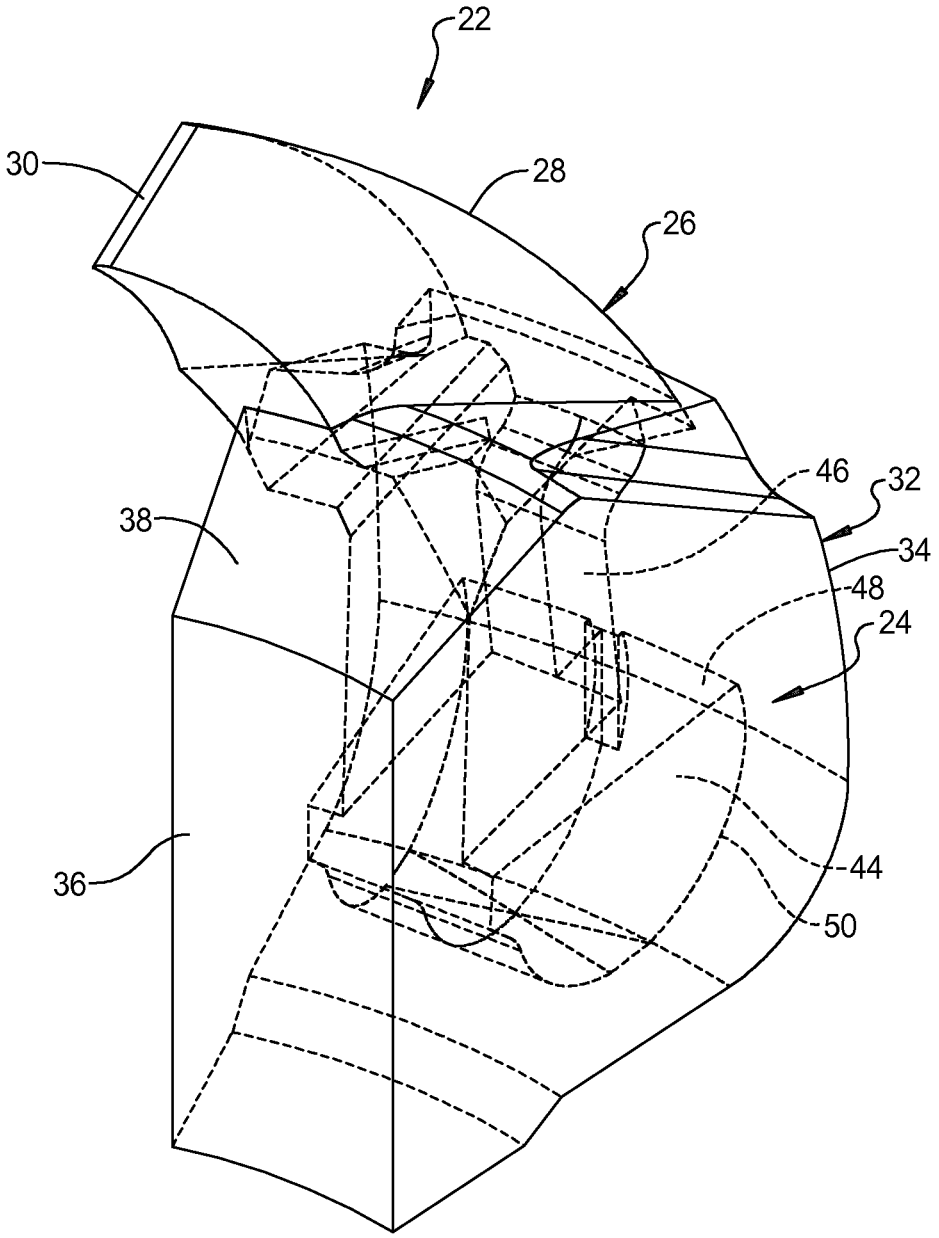
FIG. 4 is a cut-away perspective view of a segment of the seal body shown in FIG. 2.
Figure 5:
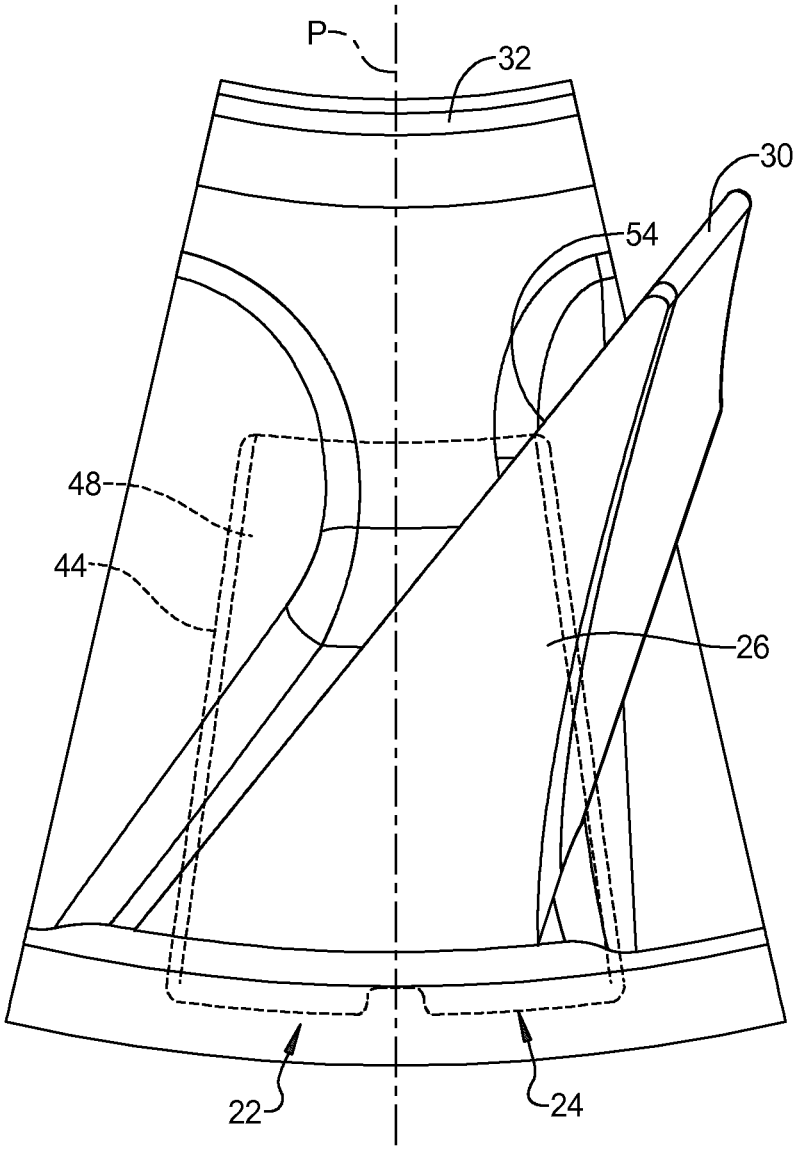
FIG. 5 is a cut away top plan view of a segment of the seal body shown in FIG. 2.

With reference to FIGS. 4 and 5, cut away views of a segment of the seal body 20 are shown with a metallic insert 22 shown over-molded within the elastomeric body 32. The base portion 24 includes an enlarged shoe region 44 and a relatively narrower neck region 46 extending between the shoe region 44 and the wedge shaped extension 26. The shoe region 44 can include a generally flat or planar surface 48 on a side facing the neck portion 46 and an arcuate surface 50 on a side facing away from the neck portion 46.

Figure 2:
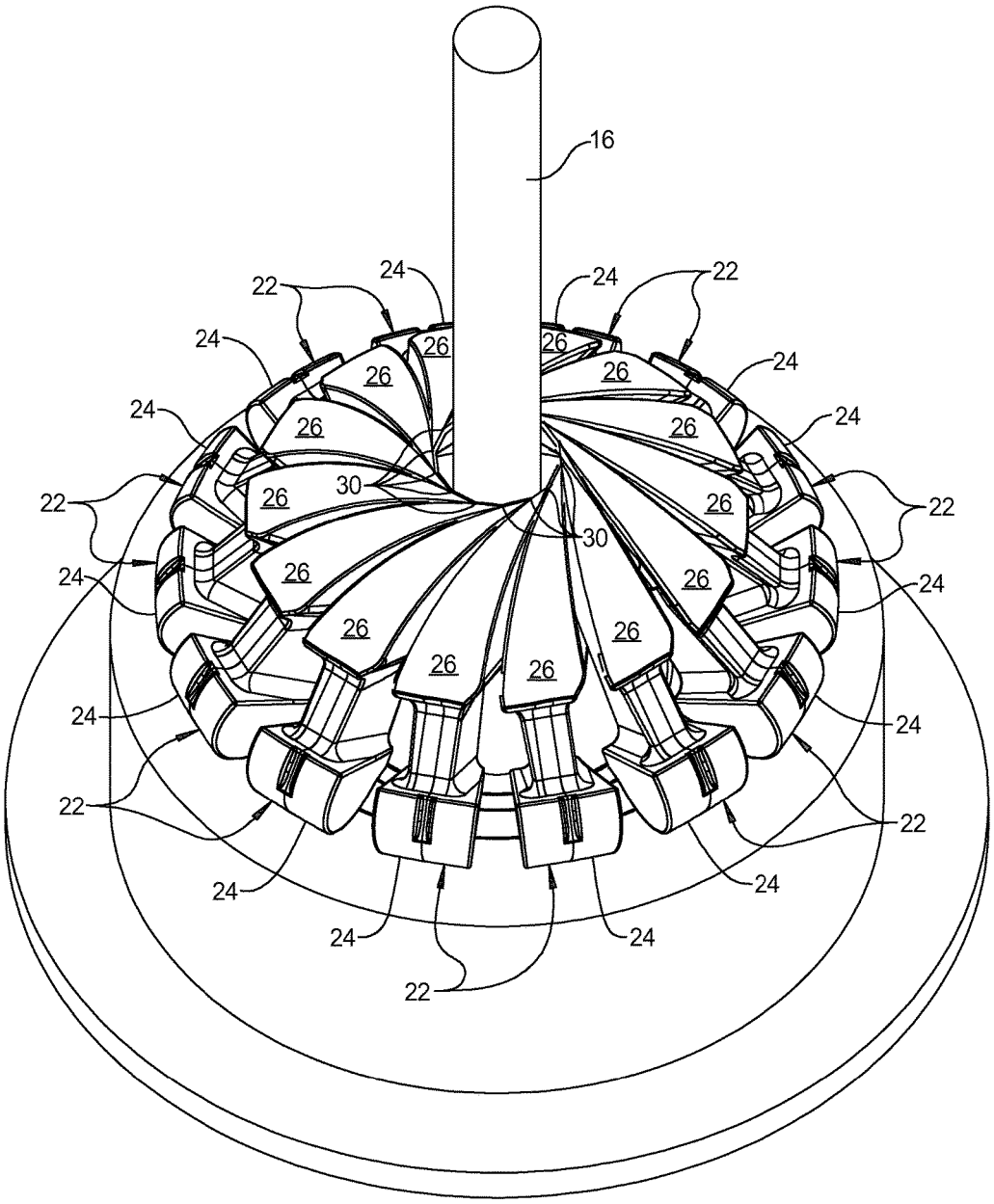
FIG. 2 is a top perspective view of the segments of the seal body of the spherical blow out preventer annular seal with the elastomeric body removed in an un-deformed state with the elastomeric body removed for illustrative purposes according to the principles of the present disclosure.
Figure 3:
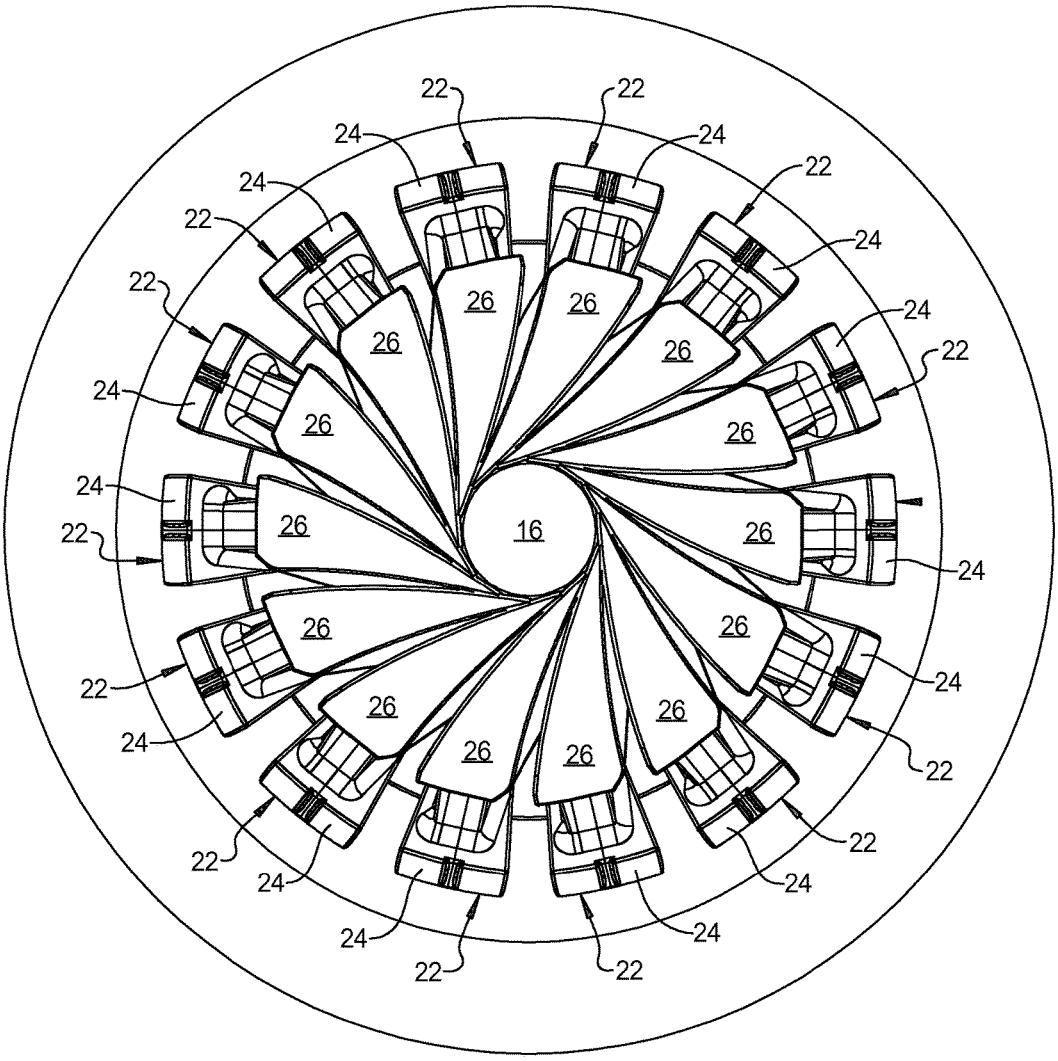
FIG. 3 is a top plan view of the seal body of the spherical blow out preventer annular seal in a deformed state sealingly engaging a pipe and with the elastomeric body removed for illustrative purposes according to the principles of the present disclosure.

With reference to FIGS. 2 and 5, the metallic inserts 22 are positioned so that the tip ends 30 point in a direction that is offset from a center axis "A" of the seal body 20. As shown in FIG. 5, the base portion 24 can be generally symmetric about a plane P that passes through a center axis of the seal body 20 while the wedge shaped extension 26 is skewed so that the plane of symmetry P of the base portion 24 intersects a side wall 54 of the wedge shaped extension 26. As shown in FIG. 1, a piston is disposed against the seal body 20. The piston 52 can be actuated to press the metallic inserts 22 upward and inward against the generally spherical interior surface 18 of the housing 12. As the metallic inserts 20 move upwardly and inwardly, the wedge shaped extensions 26 come together tangentially around the pipe to the position as shown in FIG. 3. In the un-deformed state of the seal body 20, the metallic inserts 22 are spaced from one another by a first predetermined distance and when they are moved to the deformed position, illustrated in FIG. 3, the wedge shaped extensions 26 move radially inward and circumferentially to come together tangentially around the pipe 16. In the deformed state, the tip ends 30 of each of the wedge-shaped extensions 26 are positioned directly adjacent to the side surface 54 of an adjacent wedge-shaped extension 26 at a location that is spaced from the tip end 30 of the adjacent wedge-shaped extension 26. The wedge-shaped extensions 26 combine to form an anti-extrusion barrier with the wedge-shaped extensions 26 making contact with the pipe 16 and/or with each other resulting in smaller extrusion gaps that are essential under higher temperature and pressure applications. In the embodiment shown, 14 metallic inserts 22 are shown, however it should be understood that more or fewer inserts can be utilized depending upon the desired application. The tangential movement of the inserts 22 also allows for the use of longer wedge-shaped extensions 26 resulting in smaller extrusion gaps when used across different pipe diameters within a certain range.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A spherical blow out preventer annular seal for sealing around a pipe, comprising:

a housing adapted to be disposed around the pipe and having a generally spherical interior surface;

a seal body including a plurality of metallic inserts arranged side by side in an annular pattern and each including a base portion and a wedge shaped extension having a partially spherical outer surface terminating at a tip end, and an annular elastomeric body over-molded on the base portions of the plurality of metallic inserts with the partially spherical outer surface of each of the wedge shaped extensions being supported in engagement with the interior spherical surface of the housing; and a piston engaged with the seal body to press the metallic inserts upward and inward against the generally spherical interior surface of the housing wherein said plurality of metallic inserts move radially inward until the wedge shaped extensions come into contact with the pipe and then the wedge shaped extensions continue to move tangentially around the pipe.

2. The spherical blow out preventer annular seal according to claim 1, wherein the annular elastomeric body has a partially spherical outer surface.

3. The spherical blow out preventer annular seal according to claim 2, wherein the annular elastomeric body includes a generally cylindrical inner surface.

4. The spherical blow out preventer annular seal according to claim 3, wherein the annular elastomeric body includes a conical inner surface extending from the generally cylindrical inner surface.

5. The spherical blow out preventer annular seal according to claim 1, wherein the metallic inserts are spaced from one another by a first distance when the seal body is in an un-deformed state and are moved closer together while they come together tangentially around the pipe when the seal body is in a deformed state.

6. The spherical blow out preventer annular seal according to claim 1, wherein when the metallic inserts come together tangentially around the pipe, the tip end of each of said wedge shaped extensions is directly adjacent to a side surface of an adjacent wedge shaped extension at a location that is spaced from the tip end of the adjacent wedge shaped extension.

7. The spherical blow out preventer annular seal according to claim 1, wherein the base portion of the metallic inserts have an enlarged shoe region and a relatively narrower neck region disposed between the shoe region and the wedge shaped extension.

8. The spherical blow out preventer annular seal according to claim 7, wherein the enlarged shoe region includes a generally flat surface on a side facing the neck portion and an arcuate surface on a side facing away from the neck portion.

9. The spherical blow out preventer annular seal according to claim 1, wherein the metallic inserts are positioned so that the tip ends point in a direction that is offset from a center axis of the seal body both in an un-deformed state and in a deformed state.

10. A spherical blow out preventer annular seal for sealing around a pipe, comprising:

a housing adapted to be disposed around the pipe and having a generally spherical interior surface;

a seal body including a plurality of metallic inserts arranged side by side in an annular pattern and each including a base portion and a wedge shaped extension having a partially spherical outer surface terminating at a tip end, and an annular elastomeric body over-molded on the base portions of the plurality of metallic inserts with the partially spherical outer surface of each of the wedge shaped extensions being supported in engagement with the interior spherical surface of the housing; and a piston engaged with the seal body to press the metallic inserts upward and inward against the generally spherical interior surface of the housing wherein the wedge shaped extensions move initially in a radially inward direction until the plurality of metallic inserts contact the pipe and then the wedge shaped extensions of the plurality of metallic inserts move in a circumferential direction relative to the pipe, wherein the metallic inserts are positioned so that the tip ends point in a direction that is offset from a center axis of the seal body both in an un-deformed state and in a deformed state.

11. The spherical blow out preventer annular seal according to claim 10, wherein the annular elastomeric body has a partially spherical outer surface.

12. The spherical blow out preventer annular seal according to claim 11, wherein the annular elastomeric body includes a generally cylindrical inner surface.

13. The spherical blow out preventer annular seal according to claim 12, wherein the annular elastomeric body includes a conical inner surface extending from the generally cylindrical inner surface.

14. The spherical blow out preventer annular seal according to claim 10, wherein the metallic inserts are spaced from one another by a first distance when the seal body is in an un-deformed state and are moved closer together when the metallic inserts are pressed upward and inward against the generally spherical interior surface of the housing in a deformed state.

15. The spherical blow out preventer annular seal according to claim 10, wherein when the wedge shaped extensions of the metallic inserts move in both a radially inward and a circumferential direction relative to the pipe, the tip end of each of said wedge shaped extensions is directly adjacent to a side surface of an adjacent wedge shaped extension at a location that is spaced from the tip end of the adjacent wedge shaped extension.

16. The spherical blow out preventer annular seal according to claim 10, wherein the base portion of the metallic inserts have an enlarged shoe region and a relatively narrower neck region disposed between the shoe region and the wedge shaped extension.

17. The spherical blow out preventer annular seal according to claim 16, wherein the enlarged shoe region includes a generally flat surface on a side facing the neck portion and an arcuate surface on a side facing away from the neck portion.

18. A spherical blow out preventer annular seal for sealing around a pipe, comprising:

a housing adapted to be disposed around the pipe and having a generally spherical interior surface;

a seal body including a plurality of metallic inserts arranged side by side in an annular pattern and each including a base portion and a wedge shaped extension having a partially spherical outer surface terminating at a tip end, and an annular elastomeric body over-molded on the base portions of the plurality of metallic inserts with the partially spherical outer surface of each of the wedge shaped extensions being supported in engagement with the interior spherical surface of the housing; and a piston engaged with the seal body to press the metallic inserts upward and inward against the generally spherical interior surface of the housing wherein when the plurality of metallic inserts engage the pipe the tip ends of the wedge shaped extension move along a path that is tangential to the pipe, wherein the metallic inserts are positioned so that the tip ends point in a direction that is offset from a center axis of the seal body both in an un-deformed state and in a deformed state.

* * * * *